US012571580B2

(12) United States Patent
Leachman

(10) Patent No.: US 12,571,580 B2
(45) Date of Patent: Mar. 10, 2026

(54) ADJUSTABLE MULLION FOR A REFRIGERATOR APPLIANCE

(71) Applicant: Haier US Appliance Solutions, Inc., Wilmington, DE (US)

(72) Inventor: William Jeremy Leachman, Pewee Valley, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 72 days.

(21) Appl. No.: 18/671,667

(22) Filed: May 22, 2024

(65) Prior Publication Data

US 2025/0362073 A1 Nov. 27, 2025

(51) Int. Cl.
*F25D 23/02* (2006.01)

(52) U.S. Cl.
CPC ..... *F25D 23/028* (2013.01); *F25D 2323/021* (2013.01)

(58) Field of Classification Search
CPC ..... F25D 2323/021; F25D 2400/06; F25D 23/028; F25D 23/02; F25D 23/087; F25D 21/04; F25D 2400/04
See application file for complete search history.

(56) References Cited

U.S. PATENT DOCUMENTS 7,008,032 B2 3/2006 Chekal et al.
8,167,389 B2 5/2012 Han et al.
9,506,689 B2 11/2016 Carbajal et al.
10,837,695 B2 11/2020 Baum et al.
10,995,977 B2 5/2021 Ayyawar et al.
2007/0257589 A1* 11/2007 Laible ..... F25D 23/02 312/405
2010/0071404 A1* 3/2010 Han ..... F25D 23/02 62/449
2012/0073321 A1 3/2012 Davis et al.
2014/0159560 A1* 6/2014 Jung ..... F25D 23/02 312/405
2018/0045452 A1* 2/2018 Ji ..... F25D 17/08
2018/0209209 A1* 7/2018 Ham ..... E06B 7/215
2019/0113276 A1* 4/2019 Ebrom ..... F25D 21/04
2019/0170427 A1* 6/2019 Baum ..... F25D 23/02
2020/0363122 A1* 11/2020 Park ..... F25D 23/025
2024/0191935 A1* 6/2024 Zhao ..... F25D 23/028

FOREIGN PATENT DOCUMENTS

CN 114812084 A * 7/2022 ..... F25D 23/028
WO WO2009109878 A1 9/2009

* cited by examiner

*Primary Examiner* — Hiwot E Tefera
(74) *Attorney, Agent, or Firm* — Dority & Manning, P.A.

(57) ABSTRACT

A refrigerator appliance may include a cabinet defining a chamber. The refrigerator appliance may include a door rotatably coupled to the cabinet to selectively access the chamber. The door may include a perimeter edge. The refrigerator appliance may include a mullion hinge assembly directly attached to the perimeter edge of the door. The refrigerator appliance may include an articulating mullion rotatably coupled to the door via the mullion hinge assembly to selectively seal the chamber. The refrigerator appliance may include a height adjustment element attached between the mullion hinge assembly and the articulating mullion to selectively adjust a vertical position of the articulating mullion.

15 Claims, 8 Drawing Sheets

ADJUSTABLE MULLION FOR A REFRIGERATOR APPLIANCE

FIELD OF THE DISCLOSURE

The present subject matter relates generally to a refrigerator appliance, and more particularly to features for adjusting a mullion for a refrigerator appliance.

BACKGROUND OF THE DISCLOSURE

Appliances, such as refrigerator appliances, often include one or more assemblies for sealing air therein. In the case of refrigerator appliances, one of the reasons for such a seal is to mitigate food spoilage, which presents significant health hazards and causes billions of dollars of waste around the world each year. Specifically, in order to prevent spoilage, refrigerators and freezers maintain foods at low temperatures. Properly sealing in the cold air while still allowing the consumer to easily access the freezer and fresh food compartments is one of the most important considerations in refrigerator design.

Many refrigerators provide one or more hinged doors for accessing the refrigerator cabinet. The doors generally include gaskets, which seal the door against the refrigerator cabinet when the door is closed. French-style doors are desirable because they reduce the weight load on the door hinge. French doors divide the cabinet opening in two, such that each door weighs less than a single door would weigh. That allows the size of the support structure of each door to be reduced. French doors also increase accessibility to the refrigerator cabinet and provide additional storage arrangements that are not possible with a single-door design.

However, one problem with French doors is that they require additional seals; in particular, the middle of the refrigerator opening (e.g., where the two doors meet) must maintain a seal when the doors are closed. Some French door refrigerators include a movable mullion attached to one of the doors such that access to the corresponding compartment via the respective opening is not obstructed by the mullion when the door to which the mullion is attached is opened. However, in some instances, the movable mullion may become misaligned and, as a result, may impair the sealing engagement of the doors or may inhibit the doors from opening or closing.

Accordingly, one or more elements or features for a refrigerator appliance mullion that addresses one or more of the above-described challenges would be beneficial.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet defining a chamber. The refrigerator appliance may include a door rotatably coupled to the cabinet to selectively access the chamber. The door may include a perimeter edge. The refrigerator appliance may include a mullion hinge assembly directly attached to the perimeter edge of the door. The refrigerator appliance may include an articulating mullion rotatably coupled to the door via the mullion hinge assembly to selectively seal the chamber. The refrigerator appliance may include a height adjustment element attached between the mullion hinge assembly and the articulating mullion to selectively adjust a vertical position of the articulating mullion.

In another exemplary aspect of the present disclosure, a refrigerator appliance is provided. The refrigerator appliance may include a cabinet. The cabinet may define a chamber. The cabinet may include a front frame defining a groove. The refrigerator appliance may include a door coupled to the cabinet and rotatable between an open position and a closed position to selectively access the chamber. The door may include a perimeter edge that may define a longitudinal plane. The refrigerator appliance may include a center mullion hinge attached to the perimeter edge of the door. The center mullion hinge may define an articulation axis parallel to the longitudinal plane. The refrigerator appliance may include an articulating mullion. The articulating mullion may include a body and a pin. The body may define a retaining slot for receiving the center mullion hinge. The body may be rotatably coupled to the door at the retaining slot to selectively seal the chamber. The pin may be extended from a top portion of body. The refrigerator appliance may include a height adjustment element disposed between the center mullion hinge and the body of the articulating mullion. The height adjustment element may be adjustably attached to the center mullion hinge to selectively adjust a vertical position of the articulating mullion to ensure proper engagement between the pin and the groove.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
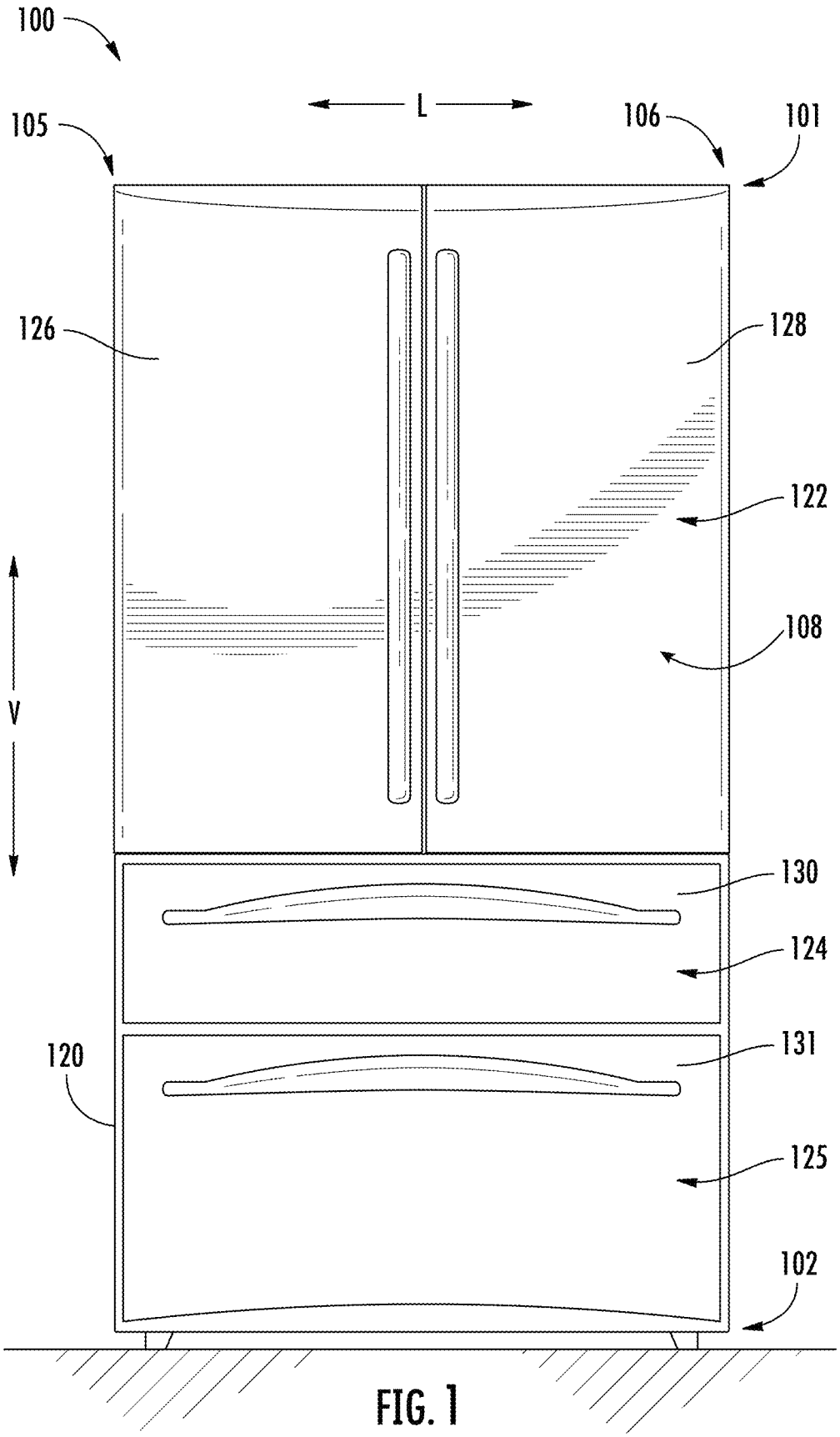
FIG. 1 provides a front view of an exemplary refrigerator appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

Except as explicitly indicated otherwise, recitation of a singular processing element (e.g., "a controller," "a processor," "a microprocessor," etc.) is understood to include more than one processing element. In other words, "a processing element" is generally understood as "one or more processing element." Furthermore, barring a specific statement to the contrary, any steps or functions recited as being performed by "the processing element" or "said processing element" are generally understood to be capable of being performed by "any one of the one or more processing elements." Thus, a first step or function performed by "the processing element" may be performed by "any one of the one or more processing elements," and a second step or function performed by "the processing element" may be performed by "any one of the one or more processing elements and not necessarily by the same one of the one or more processing elements by which the first step or function is performed." Moreover, it is understood that recitation of "the processing element" or "said processing element" performing a plurality of steps or functions does not require that at least one discrete processing element be capable of performing each one of the plurality of steps or functions.

Generally, a refrigerator appliance may be provided in some aspects of the present disclosure. The refrigerator appliance can include a cabinet defining one or more chilled chambers. One or more doors can be rotatably coupled to the cabinet to selectively provide access to the one or more chilled chambers. A door can include an articulating mullion that can selectively seal a chilled chamber of the refrigerator appliance. For instance, the articulating mullion may be pivotable about a mullion hinge assembly to a position that may prevent cooled or chilled air from flowing out of the chilled chamber when the door is in the closed position. In order to guide the rotation of the articulating mullion about the articulation axis, a mullion guide element, such as a pin or a tab, that is configured to interact with a corresponding groove defined by the cabinet may be extended from the articulating mullion. However, variations in manufacturing or assembly of the refrigerator appliance can result in the articulating mullion, and more particularly, the mullion guide element, not properly engaging with the corresponding groove.

Notably, embodiments of the present subject matter provide a height adjustment element that is attached to the mullion hinge assembly to selectively adjust a vertical position of the articulating mullion. In this regard, proper engagement between the mullion guide element and the cabinet can be ensured (e.g., irrespective of variations in shipping, storage, or manufacture; or while permitting faster or less-cumbersome assembly processes). Moreover, the presence of the height adjustment element advantageously improves the performance of the articulating mullion. For example, conventional articulating mullions typically have no vertical adjustability. With such articulating mullions, when the mullion guide element is not properly received by the corresponding groove, the articulating mullion may not properly seal the chilled chambers of the refrigerator appliance. Thus, performance of the refrigerator appliance may be decreased. Accordingly, the height adjustment element advantageously ensures proper engagement between the articulating mullion and the cabinet to maintain or increase performance of the refrigerator appliance.

FIG. 1 provides a front view of an exemplary refrigerator appliance 100 according to an exemplary embodiment of the present disclosure. Refrigerator appliance 100 extends between a top 101 and a bottom 102 along a vertical direction V. Refrigerator appliance 100 also extends between a first side 105 and a second side 106 along a lateral direction L. Further, refrigerator appliance 100 extends between a front and a back along a transverse direction T (not shown in FIG. 1), which is a direction orthogonal to the lateral direction L. Vertical direction V, lateral direction L, and transverse direction T are mutually perpendicular and form an orthogonal direction system.

Refrigerator appliance 100 includes a housing or cabinet 120 defining a fresh food chamber 122 and one or more freezer chambers, such as a first freezer chamber 124 and a second freezer chamber 125, which may both be arranged below fresh food chamber 122 along the vertical direction V. As such, refrigerator appliance 100 may generally be referred to as a bottom mount refrigerator. Cabinet 120 also defines a mechanical compartment (not shown) for receipt of a sealed cooling system (not shown). It will be appreciated that the present subject matter can be used with other types of refrigerators appliances as well, such as e.g., side-by-side refrigerator appliances. Consequently, the description set forth herein is not intended to limit the present subject matter in any aspect.

Refrigerator doors 126, 128 are rotatably hinged to an edge of cabinet 120 for accessing fresh food chamber 122. For example, upper and lower hinges may couple each door 126, 128 to cabinet 120. It should be noted that while doors 126, 128 are configured in a "French door" configuration in FIG. 1, any suitable arrangement of doors utilizing one, two or more doors is within the scope and spirit of the present disclosure. Freezer doors, such as a first freezer door 130 and a second freezer door 131, are arranged below refrigerator doors 126, 128 for accessing one or more freezer chambers, such as first and second freezer chambers 124, 125, respectively. In the exemplary embodiment shown in FIG. 1, freezer doors 130, 131 are coupled to freezer drawers (not shown) slidably coupled within freezer chambers 124, 125. Such drawers are thus generally "pull-out" drawers in that they can be manually moved into and out of freezer chambers 124, 125 on suitable slide mechanisms. Each door 126, 128, 130, 131 can include a handle for accessing one of the chambers 122, 124, 125 of refrigerator appliance 100.

Figure 2:
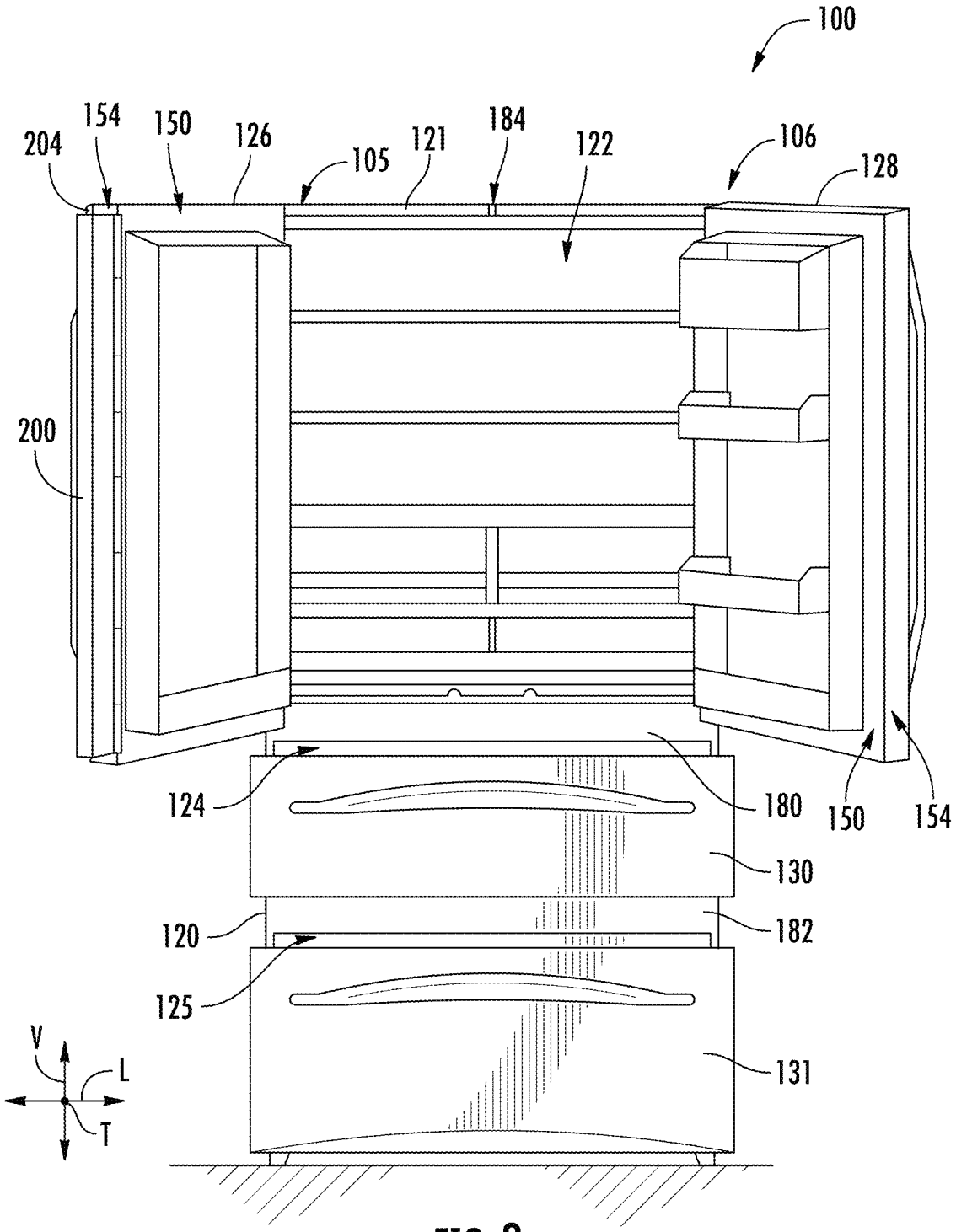
FIG. 2 provides a front view of the refrigerator appliance of FIG. 1 with refrigerator doors shown in an open configuration.

FIG. 2 provides a front perspective view of refrigerator appliance 100 showing refrigerator doors 126, 128 in an open position to reveal the interior of fresh food chamber 122. Additionally, freezer doors 130, 131 are shown in partially open positions to reveal a portion of the interior of freezer chambers 124, 125, respectively.

Figure 3:
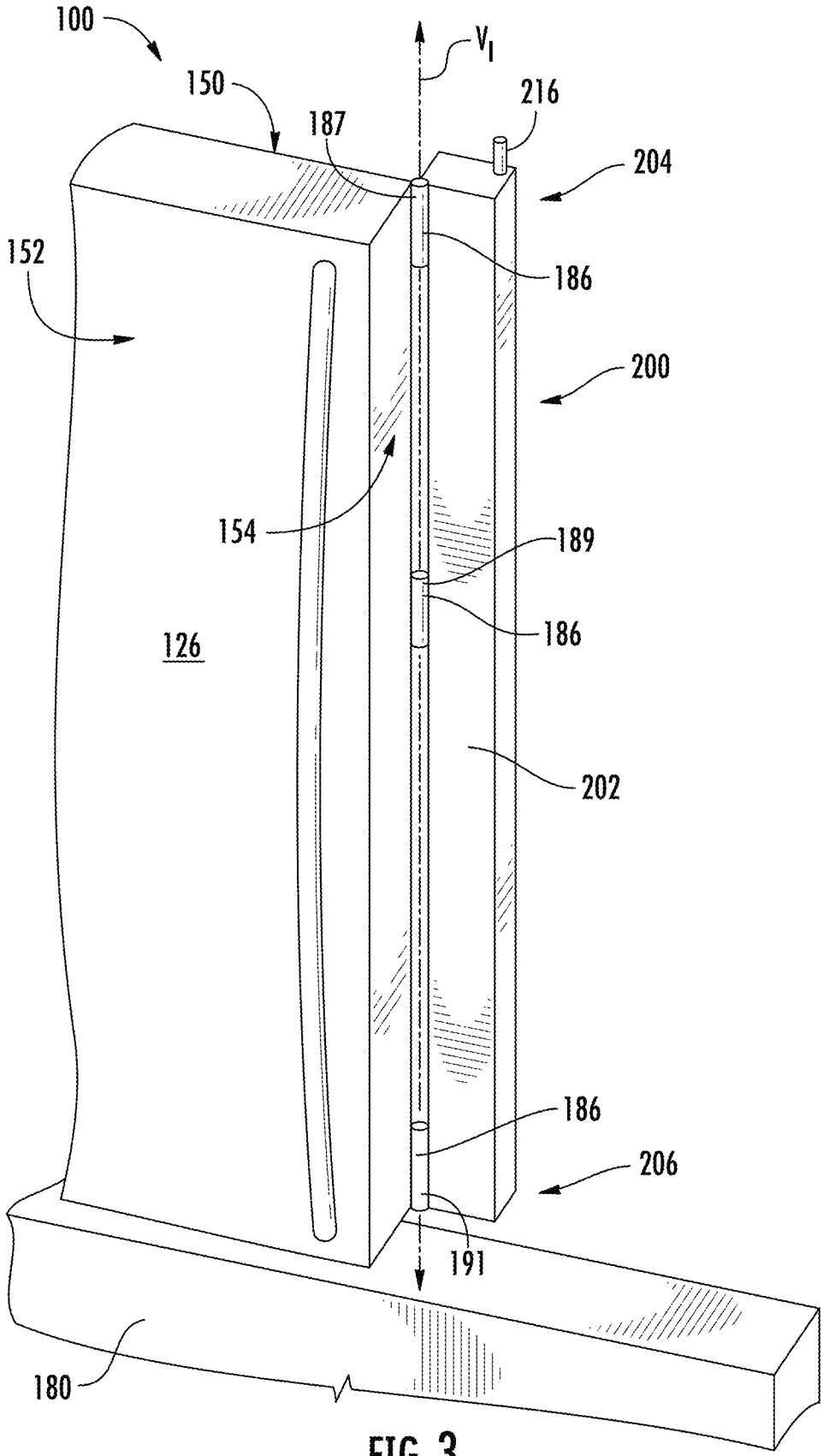
FIG. 3 provides a perspective view of a door, a stationary mullion, and an articulating mullion connected to the door of the refrigerator appliance of FIG. 1.

Door 126 of refrigerator appliance 100 includes an inner surface 150 and an outer surface 152 (FIG. 3). Inner surface 150 generally defines a portion of the interior of fresh food chamber 122 when door 126 is in a closed position as shown in FIG. 1. For instance, the inner surface 150 of the doors 126 may interface with a front frame 121 of the cabinet 120 when the door 126 is in the closed position. Outer surface 152 is generally opposite inner surface 150 and defines a portion of the exterior of refrigerator appliance 100 when door 126 is in the closed position. Door 126 includes side surfaces 154 extending between and connecting inner surface 150 and outer surface 152. It will be appreciated that door 128 can be configured in the same or similar manner as door 126. Moreover, it will further be appreciated that freezer doors 130, 131 can likewise include inner, outer, and side surfaces 150, 152, 154.

As further shown in FIG. 2, refrigerator appliance 100 includes various mullions. Mullions generally divide the various chambers of refrigerator appliance 100 or prevent leakage therefrom. For this embodiment, refrigerator appliance 100 includes a stationary mullion 180 disposed between and separating fresh food chamber 122 and first freezer chamber 124. Refrigerator appliance 100 also includes a stationary mullion 182 disposed between and separating first freezer chamber 124 and second freezer chamber 125. Stationary mullions 180, 182 generally extend along the lateral direction L between first side 105 and second side 106 of refrigerator appliance 100 and generally extend along the vertical direction V to separate the various chambers of refrigerator appliance 100. Moreover, although not shown in FIG. 2, stationary mullions 180, 182 generally extend along the transverse direction T approximately the depth of refrigerator appliance 100.

Refrigerator appliance 100 also includes an articulating mullion 200 rotatably coupled or connected to door 126 as shown in FIG. 2. In other embodiments, articulating mullion 200 can be connected to door 128. In yet other embodiments, articulating mullion 200 can be connected to any suitable door of refrigerator appliance 100. Moreover, refrigerator appliance 100 can include any suitable number of articulating mullions 200. For example, where refrigerator appliance 100 has a quad door configuration (e.g., having two rotatably mounted "French door" fresh food doors and two rotatably mounted "French door" freezer doors positioned below the fresh food doors), refrigerator appliance 100 can include one articulating mullion 200 connected to one of the freezer doors and one articulating mullion connected to one of the fresh food doors.

Figure 4:
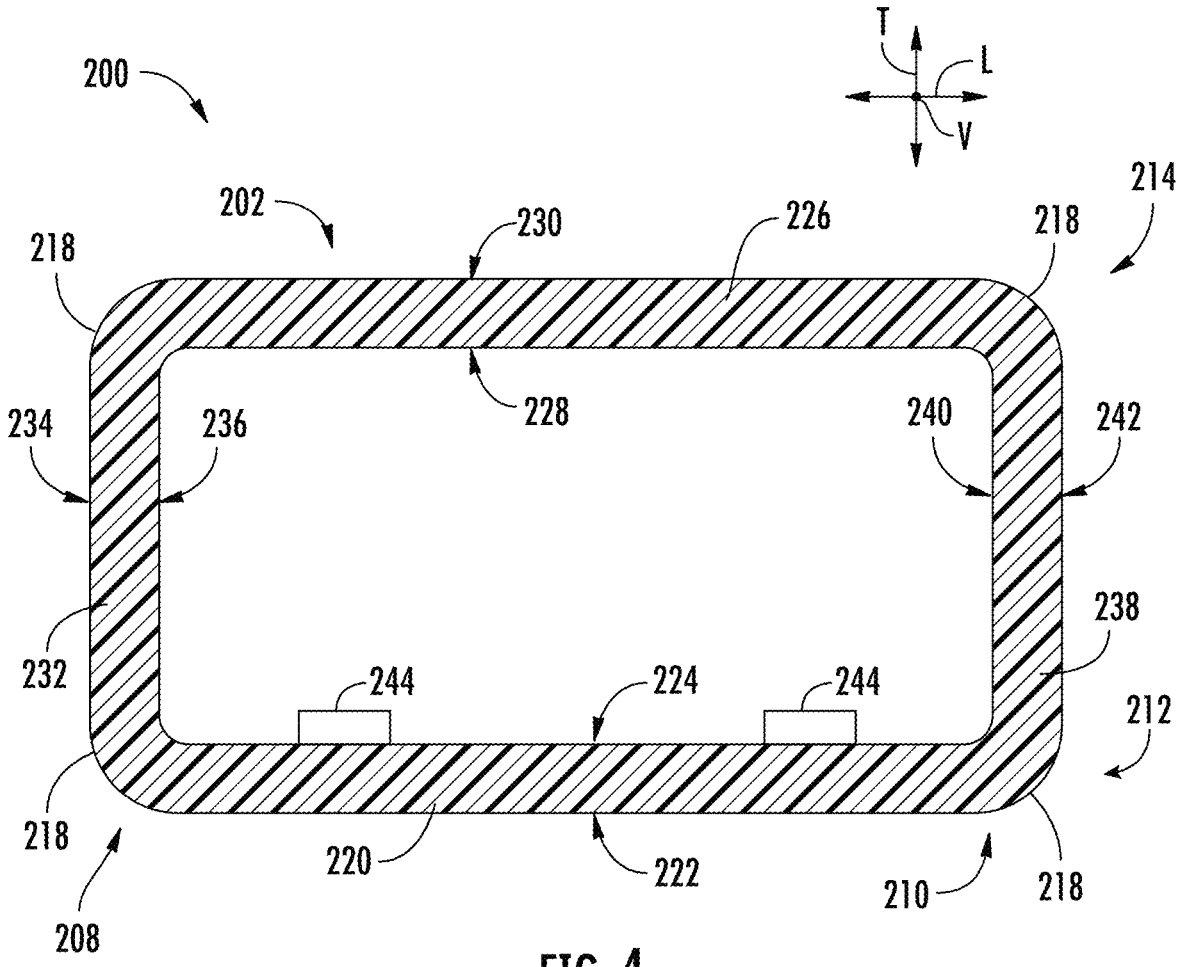
FIG. 4 is a cross-sectional view of the articulating mullion of FIG. 3.

Referring now to FIGS. 2 through 5, the articulating mullion 200 and components thereof are described in detail herein. As illustrated in FIGS. 3 and 4, the articulating mullion 200 can be rotatably coupled or rotatably hinged, via mullion hinge assembly 186, to door 126. For example, the articulating mullion 200 may be rotatably coupled or rotatably hinged at a longitudinal plane defined by the side surface 154 of the door 126 (e.g., extending parallel to the vertical direction V). Mullion hinge assembly 186 may include a top mullion hinge 187, a center mullion hinge 189, and a bottom mullion hinge 191. The top mullion hinge 187, the center mullion hinge 189, and the bottom mullion hinge 191 may each be attached to the perimeter edge of the door and spaced vertically along the perimeter edge of the door 126.

In some other embodiments, the mullion hinge assembly 186 can include any suitable number of hinges. For instance, in some embodiments, the mullion hinge assembly 186 can include additional hinges or hinge components, such as four or more hinges. In some other embodiments, the mullion hinge assembly 186 can include less than three hinges, such as two hinges.

Generally, the articulating mullion 200 can be rotated or articulated about an articulation axis $V_1$ (e.g., parallel to the longitudinal plane or the vertical direction V) defined by the mullion hinge assembly 186 as shown. Articulating mullion 200 may be rotatable about hinges 186 between a first position (e.g., corresponding to the open position of the door 126) and a second position (e.g., corresponding to a closed position of the door 126).

Articulating mullion 200 generally includes a body 202. For this embodiment, body 202 has a generally rectangular cross-sectional shape. It will be appreciated that body 202 can have any suitable cross-sectional shape, such as e.g., a circular, oval, or other polygonal cross-sectional shape. Body 202 extends between a top portion 204 and a bottom portion 206 along the vertical direction V (FIG. 3), between a first end 208 and a second end 210 along the lateral direction L (FIG. 4), and between a front 212 and a rear 214 along the transverse direction T (FIG. 4).

Articulating mullion 200 includes a pin 216 extending from body 202 as shown in FIG. 3. For this exemplary embodiment, pin 216 extends from top portion 204 of body 202. In some embodiments, pin 216 can extend from bottom portion 206 of body 202. In yet other embodiments, body 202 can include tabs 216 extending from both top portion 204 and bottom portion 206. Pin 216 may be sized and shaped to fit within and interact with a groove 184 defined in cabinet 120 of refrigerator appliance 100 (FIG. 2). In turn, pin 216 may be complementary to at least a portion of groove 184. For example, groove 184 may include cam surfaces that may interact with pin 216 to cause rotation of articulating mullion 200 when door 126 is rotated from a closed to open position or vice versa.

As an illustrative example, as the door 126 is moved (e.g., between the open position and the closed position), the pin 216 may interact with the cam surfaces of the groove 184. The interaction between the pin 216 and the cam surfaces of the groove 184 may cause rotation of the articulating mullion 200 (e.g., about the articulation axis $V_1$) between the first position (e.g., corresponding to the open position of the door 126) and the second position (e.g., corresponding to a closed position of the door 126).

In the first position, the articulating mullion 200 may extend approximately parallel to a side surface 154 of the door 126. As the door 1236 is transitioned from the open position to the closed position, the groove 184 may receive the pin 216. When the pin 216 enters the space defined by the groove 184, the pin 216 may interact with the cam surfaces of the groove to hinge or pivot the articulating mullion 200 from the first position to the second position. In the second position, the articulating mullion 200 may extend approximately perpendicular to the side surface 154 of the door 126. In the second position (e.g., when the door 126 is in the closed position) the articulating mullion 200 may seal the fresh food chamber 122 of the refrigerator appliance 100. When transitioning from the door 126 from the closed position to the open position, the reverse process may be executed and the articulating mullion 200 may be transitioned from the second position to the first position.

As shown in FIG. 4, body 202 includes a front wall 220 having a front face 222 and a rear face 224 opposite front face 222. When door 126 is in the closed position, front wall 220 is oriented in a plane parallel to the vertical and lateral directions V, L. Likewise, front face 222 and rear face 224 of front wall 220 are coplanar with the vertical and lateral direction V, L. Body 202 also includes a rear wall 226 having a front face 228 and a rear face 230 opposite front face 228. Rear wall 226 extends in a plane parallel to the vertical and lateral directions V, L (when door 126 is in the closed position) and is spaced apart in the transverse direction T from front wall 220 as shown. Likewise, front face 228 and rear face 230 of rear wall 226 are coplanar with the vertical and lateral direction V, L. Front face 222 of front wall 220 faces the exterior of refrigerator appliance 100 and rear face 230 of rear wall 226 faces the interior of refrigerator appliance 100 when door 126 is in a closed position.

Body 202 further includes a first sidewall 232 having a first face 234 and a second face 236 opposite first face 234. A transition portion 218 connects first sidewall 232 with front wall 220 at first end 208 of body 202. Another transition portion 218 connects first sidewall 232 with rear wall 226 at first end 208 of body 202. First sidewall 232 extends in a plane parallel to the transverse and vertical directions T, V when door 126 is in the closed position. Body 202 also includes a second sidewall 238 having a first face 240 and a second face 242 opposite first face 240. Another transition portion 218 connects second sidewall 238 with front wall 220 at second end 210 of body 202. Another transition portion 218 connects second sidewall 238 with rear wall 226 at second end 210 of body 202. Second sidewall 238 extends in a plane parallel to the transverse and vertical directions T, V (when door 126 is in the closed position) and is spaced apart from first sidewall 232 in the lateral direction L by front and rear walls 220, 226. For this embodiment, as shown in FIG. 4, body 202 formed by front wall 220, rear wall 226, and first and second sidewalls 232, 234 has a generally hollow shape. However, in some embodiments, articulating mullion 200 can be a solid member.

In addition, as shown in FIG. 4, articulating mullion 200 may include a heating device 244 for preventing condensation buildup on the various surfaces of body 202 of articulating mullion 200. For this embodiment, heating device 244 is a heater that includes tubular member or elements that radiate heat therefrom. In FIG. 4, two tubular members of the heater are shown. Heating device 244 may be attached to rear surface 224 of front wall 220, embedded within front wall 220, or positioned in any other suitable location. It will be appreciated, however, that heating device 244 may be any suitable type of heating device. In particular, heating device 244 may be any suitable electrically driven heating element capable of heating one or more surfaces of articulating mullion 200.

Figure 5:
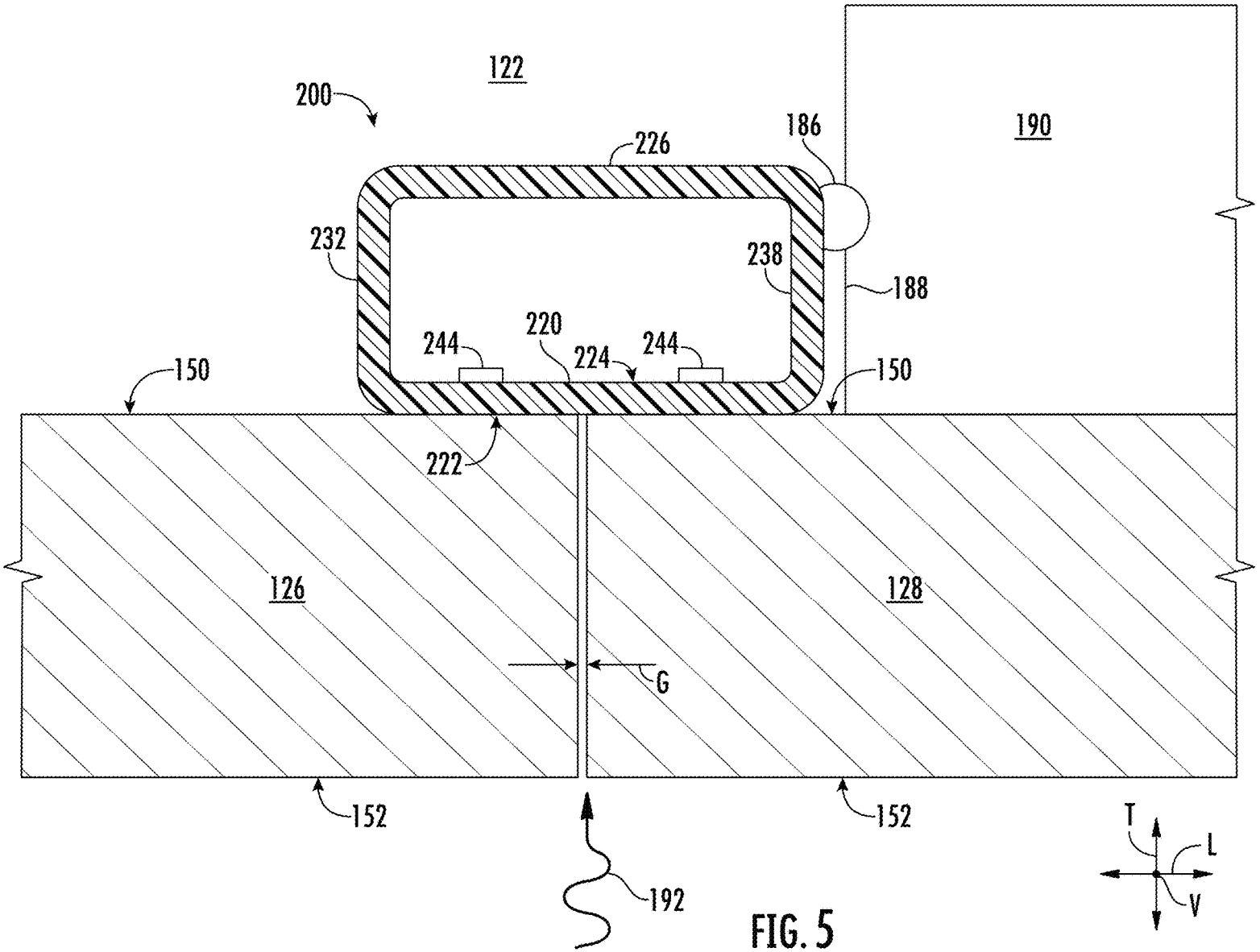
FIG. 5 provides a close-up, cross-sectional view of doors of an exemplary refrigerator appliance in a closed position and an exemplary articulating mullion in a second position according to an exemplary embodiment of the present disclosure.

FIG. 5 provides a close-up, cross-sectional view of doors 126, 128 of exemplary refrigerator appliance 100 in a closed position and contacting articulating mullion 200 according to an exemplary embodiment of the present disclosure. For this embodiment, articulating mullion 200 is rotatably coupled or hinged to door 128 via hinge 186. In particular, articulating mullion 200 is connected to a bin wall 188 of a bin 190 of door 128. Bin 190 is connected to inner surface 150 of door 128.

As shown in FIG. 5, when doors 126, 128 are in a closed position, articulating mullion 200 is generally positioned between doors 126, 128 along the lateral direction L. Accordingly, articulating mullion 200 may prevent leakage between doors 126, 128. More specifically, when doors 126, 128 are in a closed position, a gap G is defined between doors 126, 128. Ambient air 192, which is generally warm relative to the cooled or chilled air of chambers 122, 124, 125 of refrigerator appliance 100, flows through gap G and contacts front face 222 of front wall 220 of articulating mullion 200. As articulating mullion 200 is positioned to block the airflow through gap G, articulating mullion 200 prevents relatively warm ambient air 192 from leaking into refrigerator appliance 100. Articulating mullion 200 also prevents cooled or chilled air from flowing out of refrigerator appliance 100. To prevent such leakage, inner surfaces 150 of each door 126, 128, or gaskets along such inner surfaces 150, contact front face 222 of articulating mullion 200. To hermetically seal front face 222 with doors 126, 128, each door 126, 128 (or one or more gaskets positioned along inner surfaces 150 of doors 126, 128) and articulating mullion 200 can include magnets or be formed of materials having magnetic properties to seal doors 126, 128 in sealing engagement with articulating mullion 200.

As will be appreciated, energy losses occur through conductive heat transfer across the transverse thickness (e.g., the distance from front surface 222 of front wall 220 to the rear surface 230 (e.g., FIG. 4) of rear wall 226) of articulating mullion 200 due to the temperature differential between front wall 220 and rear wall 226. And more particularly, energy losses occur through conductive heat transfer across the transverse thickness of front wall 220 due to the temperature differential between front face 222 and rear face 224 of front wall 220. Specifically, it will be appreciated that there is heat leak from relatively warm front face 222 to relatively cool rear face 224 (e.g., heat loss from the higher energy state to the lower energy state). In addition, it will be appreciated that energy losses occur through conductive heat transfer from first sidewall 232 to front wall 220 as well as from second sidewall 238 to front wall 220.

In this regard, it will be appreciated that heat leak does not occur exclusively across the transverse thickness of mullion 200.

When the temperature of front face 222 is below the dew point, or dew-point temperature of the surrounding ambient air 192, the water vapor within ambient air 192 tends to condense to a liquid phase on front face 222. Stated alternatively, front face 222 begins to "sweat." In such a circumstance, heating device 244 heats front wall 220 to a predetermined temperature such that the condensed water is evaporated from front face 222. Moreover, front wall 220 is warmed to the predetermined temperature to prevent further condensation on front face 222 of front wall 220. With each use of heating device 244, refrigerator appliance 100 consumes energy, and thus, the more often heating device 244 is utilized, the less energy efficient refrigerator appliance 100 may be. As explained more fully below, various exemplary embodiments of articulating mullion 200 are provided that include features for reducing the rate of conductive heat transfer across articulating mullion 200 so that heating device 244 can be used less often. In this way, refrigerator appliance 100 may be able to achieve improved energy efficiency.

According to one or more exemplary embodiments of the present subject matter the refrigerator appliance 100 may notably include a height adjustment element 300. The height adjustment element 300 may be adjustably attached to the mullion hinge assembly 186 to selectively adjust a vertical position of the articulating mullion 200 (e.g., relative to the side surface 154 of the door). Notably, the vertical position of the articulating mullion 200 may be adjustable relative to the side surface 154 of the door via the height adjustment element 300. In this regard, proper engagement between the articulating mullion 200 and a corresponding groove 184 (e.g., a channel or a slot) defined by the front frame 121 of the cabinet 120 may be ensured. Specifically, the groove 184 may be shaped and sized to receive the pin 216. When properly engaged, the corresponding groove 184 may engage with the pin 216 to transition the articulating mullion 200 between the first position and the second position or vice versa.

Figure 6:
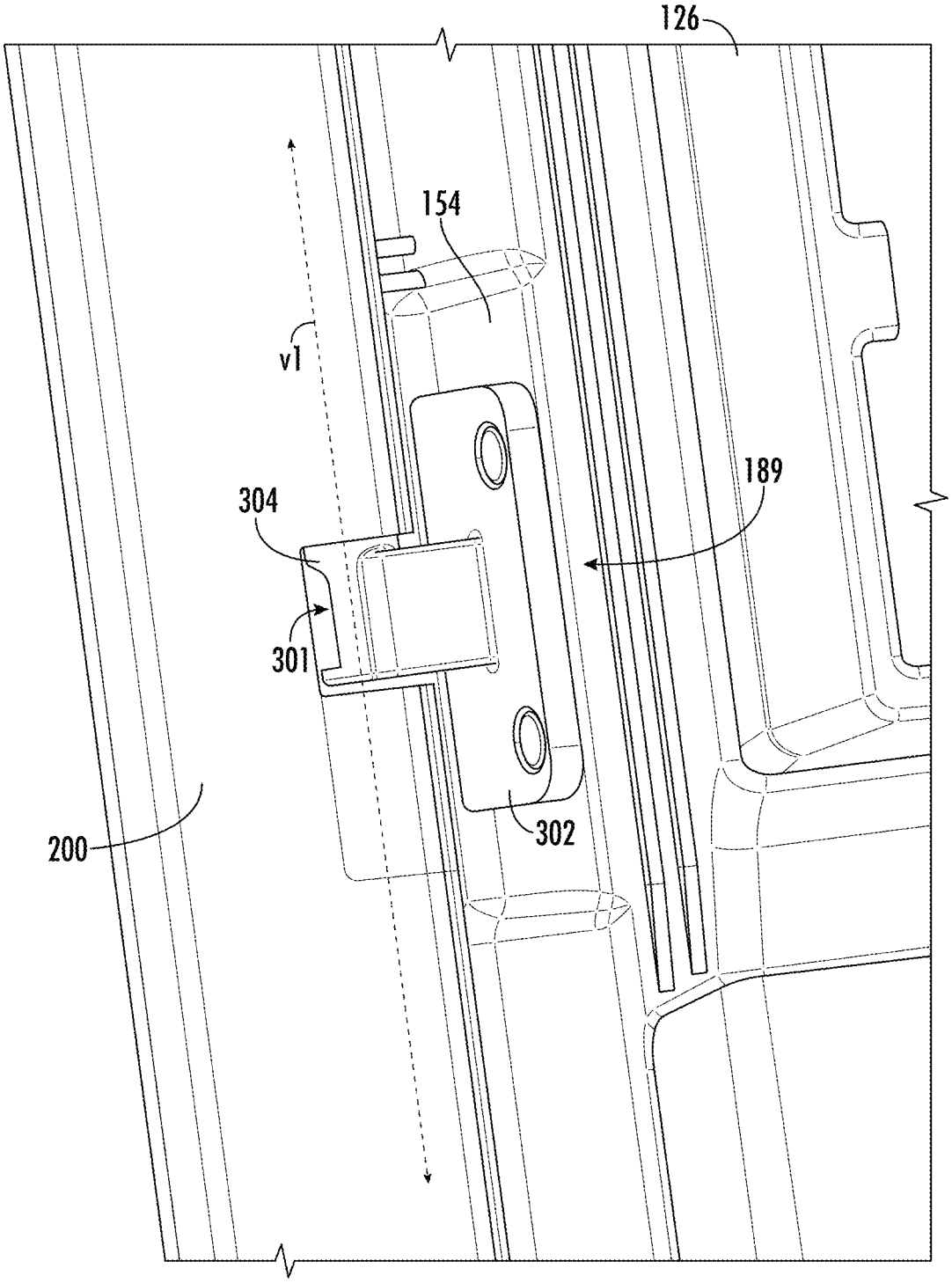
FIG. 6 provides a rear perspective view of a door of an exemplary refrigerator appliance.
Figure 7:
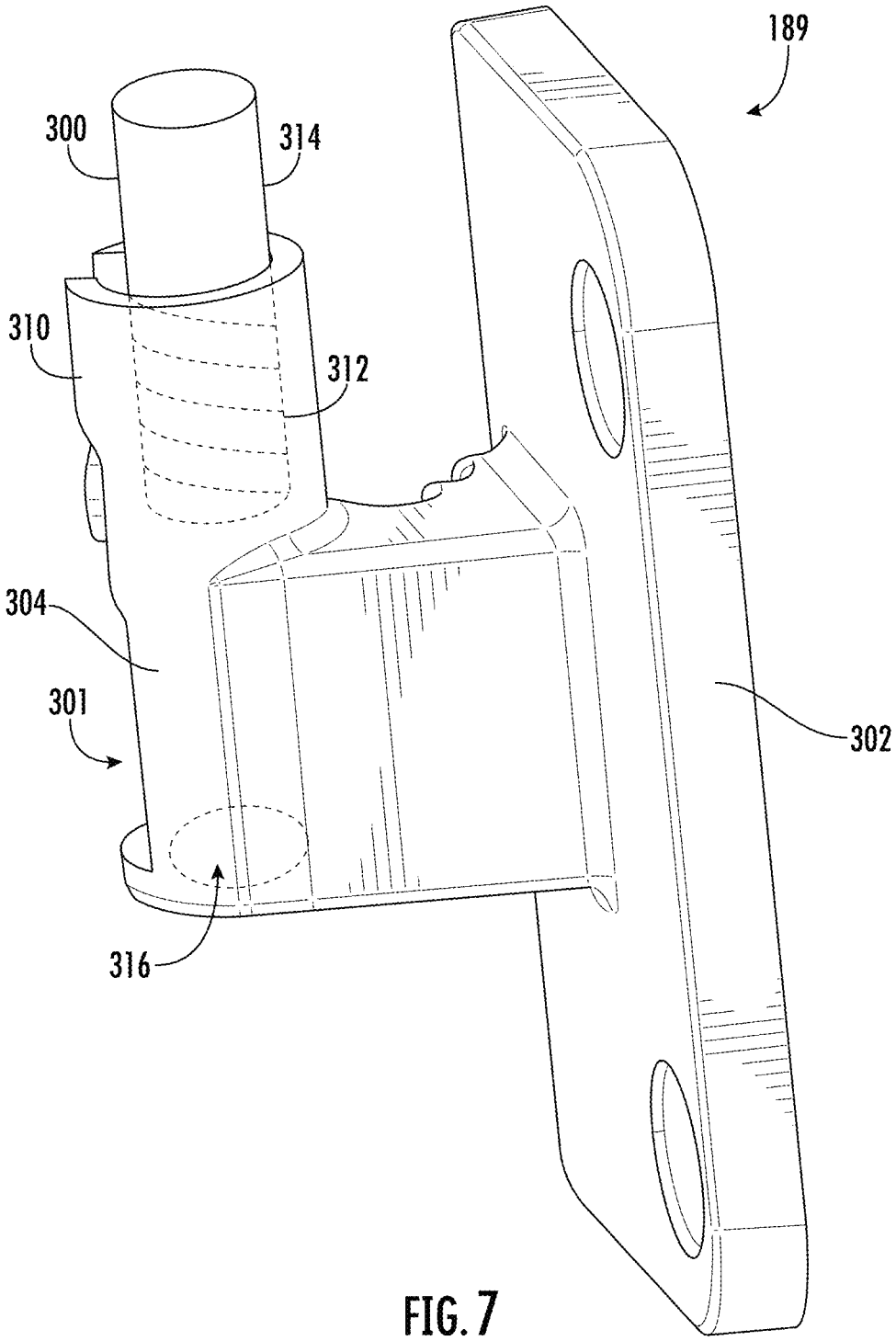
FIG. 7 provides a perspective view of a center mullion hinge of an exemplary mullion hinge assembly.
Figure 8:
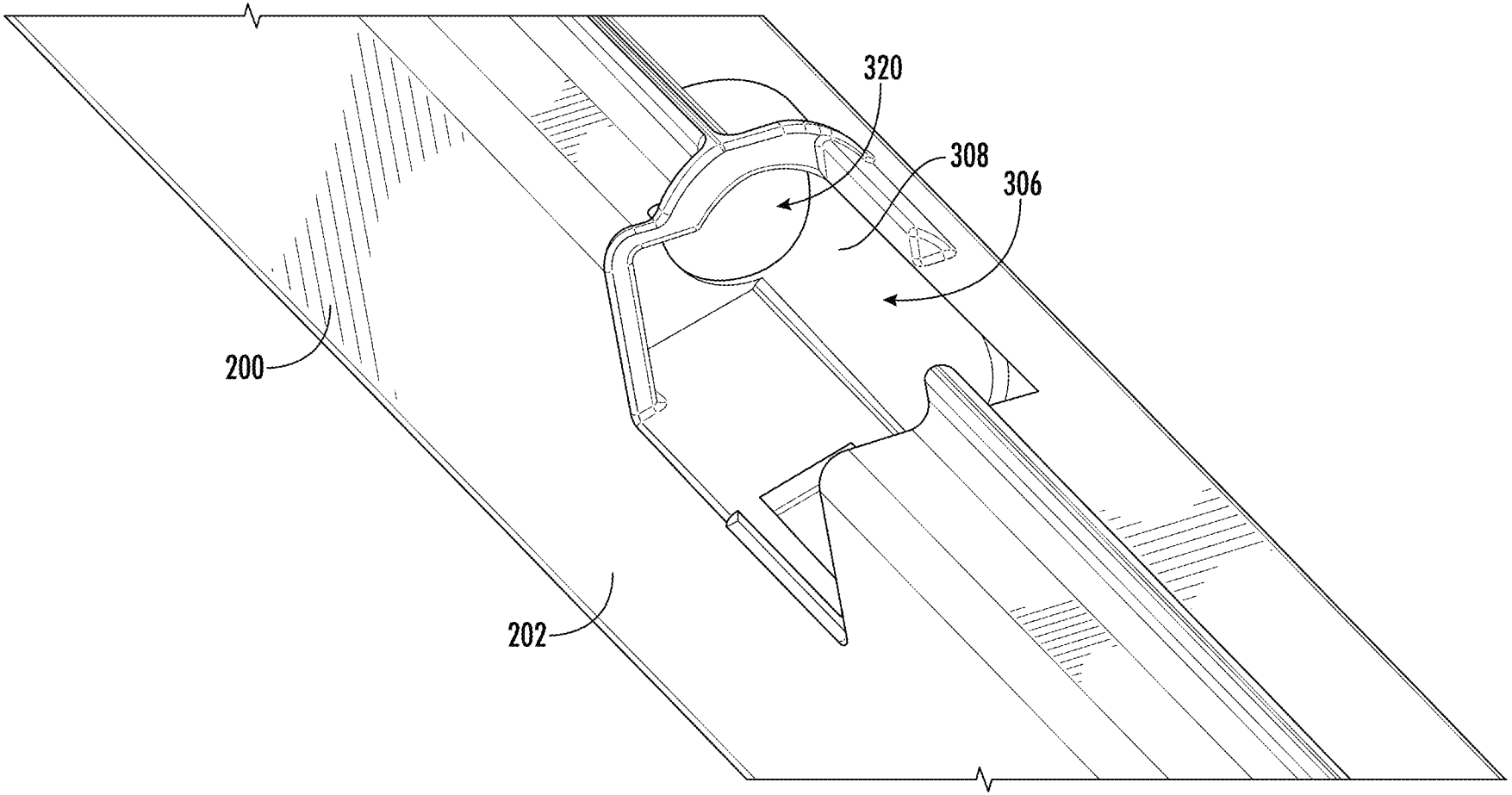
FIG. 8 provides a perspective view of a body of an exemplary articulating mullion.

Referring now to FIGS. 6 through 8, the articulating mullion 200 and a height adjustment element 300 attached thereto are described herein. In some embodiments, the height adjustment element 300 is adjustably attached to a load hinge (e.g., a hinge that accommodates a power supply line from the door to the articulating mullion 200) of the mullion hinge assembly 186. For instance, in some embodiments, the center mullion hinge 189 may be the load hinge of the mullion hinge assembly 186 and may define a slot or a passage 301 therethrough for receiving a power supply line from the door 126. The power supply line may power one or more power consuming components (e.g., the heater device 244 described above) positioned within the articulating mullion 200.

In some embodiments, the center mullion hinge 189 may include a mounting plate 302 and a pivot body 304. The mounting plate 302 may be fastened (e.g., mechanically fastened such as via screws, bolts, etc.) to the side surface 154 of the door 126. The pivot body 304 may be extended outward from the mounting plate 302. Particularly, the pivot body 304 may be extended outward from the mounting plate 302 such that it is in line with the articulation axis $V_1$ defined by the mullion hinge assembly 186. In some embodiments, the pivot body 304 is received within a retaining slot 306 defined within the body 202 of the articulating mullion 200. For example, as best illustrated in FIG. 8, the retaining slot 306 may be a cavity that is complementary in shape to the pivot body 304. The retaining slot 306 may be defined by retaining walls 308 positioned within the body 202 of the articulating mullion 200. The retaining walls 308 may be configured to accommodate rotation of the pivot body 304. For instance, retaining walls 308 may be positioned around an extension arm 310 of the pivot body 304 such as to form an articulation point for the articulating mullion 200.

In some embodiments, the height adjustment element 300 may be a mechanical threaded hinge pin adjustably attached to the center mullion hinge 189. Generally, the height adjustment element 300 may be adjustably attached to the extension arm 310 of the pivot body 304. For instance, the height adjustment element 300 may include a threaded portion 312 and an engagement portion 314 extended from the threaded portion (e.g., along the articulation axis $V_1$). The pivot body 304 may include a complementary threaded portion for receiving the threaded portion 312 of the height adjustment element 300. The threaded portion 312 of the height adjustment element 300 and the complementary threaded portion of the pivot body 304 may be in threaded engagement. The height adjustment element 300 may be adjustable (e.g., vertically moveable) relative to the pivot body 304 via the threaded engagement. For example, the pivot body 304 may define an access hole 316 for receiving an adjustment tool (e.g., a key, such as a ninety-degree hex key) therethrough. As illustrated in FIG. 8, the access hole 316 may be defined through a bottommost wall of the pivot body 304. In this regard, the height adjustment element 300 may be selectively adjustable via the adjustment tool, for instance, when the pivot body 304 is positioned within the retaining slot 306.

To selectively raise or lower the height adjustment element 300, the height adjustment element 300 may be rotated clockwise or counterclockwise (e.g., via an adjustment tool) relative to the pivot body 304. Thus, due to the threaded engagement between the height adjustment element 300 and the pivot body 304, the rotation of the height adjustment element 300 may result in vertical movement of the height adjustment element 300.

In addition, the retaining walls 308 may be configured to intimately engage (e.g., in direct contact) with the height adjustment element 300, which is adjustably attached to the pivot body 304. For instance, the retaining walls 308 may include one or more features or surfaces that may intimately engage or interface with the height adjustment element 300. For example, the retaining walls 308 may include engagement surfaces or apertures that may directly interface or intimately engage with the height adjustment element 300. As illustrated in FIG. 8, the retaining walls 308 define an engagement aperture 320 that the height adjustment element 300 can be press fit into. In this regard, due to the tight fit between the height adjustment element 300 and the engagement aperture 320, when the height adjustment element 300 is raised or lowered relative to the pivot body 304, the vertical position of the articulating mullion 200 relative to the side surface 154 of the door 126 may be raised or lowered accordingly.

In some other embodiments, the retaining walls 308 include an engagement surface within the body 202 extending perpendicular to the longitudinal plane. In such embodiments, the engagement portion 314 of the height adjustment element 300 may interface with the engagement surface to engage with the body 202 of the articulating mullion 200. Moreover, in such embodiments, due to the engagement between the height adjustment element 300 and the engagement surface, when the height adjustment element 300 is raised or lowered relative to the pivot body 304, the vertical position of the articulating mullion 200 relative to the side surface 154 of the door 126 may be raised or lowered accordingly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet defining a chamber;

a door rotatably coupled to the cabinet to selectively access the chamber; the door comprising a perimeter edge;

a mullion hinge assembly directly attached to the perimeter edge of the door, the mullion assembly comprising a mounting plate and a pivot body comprising a complementary threaded portion, wherein the mounting plate is fastened to the door, and wherein the pivot body is extended outward from the mounting plate;

an articulating mullion rotatably coupled to the door via the mullion hinge assembly to selectively seal the chamber; and a height adjustment element attached between the mullion hinge assembly and the articulating mullion to selectively adjust a vertical position of the articulating mullion, the height adjustment element comprising a threaded portion, wherein the threaded portion of the height adjustment element and the complementary threaded portion of the pivot body are in threaded engagement to adjustably attach the height adjustment element to the mullion hinge assembly.

2. The refrigerator appliance of claim 1, wherein the cabinet defines a groove, wherein the articulating mullion comprises a pin extended from a top thereof, wherein the pin is selectively received within the groove in a closed position of the door.

3. The refrigerator appliance of claim 2, wherein the groove comprises cam surfaces, and wherein the pin is positioned within the cam surfaces of the groove in the closed position of the door.

4. The refrigerator appliance of claim 1, wherein the perimeter edge of the door defines a longitudinal plane, wherein the mullion hinge assembly defines an articulation axis parallel to the longitudinal plane, and wherein the height adjustment element is attached to the mullion hinge assembly along the articulation axis.

5. The refrigerator appliance of claim 1, wherein the mullion hinge assembly comprises a top mullion hinge, a center mullion hinge, and a bottom mullion hinge, wherein the center mullion hinge comprises the mounting plate and the pivot body, and wherein the height adjustment element is adjustably attached to the center mullion hinge.

6. The refrigerator appliance of claim 5, wherein the articulating mullion comprises one or more power consuming components therewithin, wherein the center mullion hinge defines a slot for receiving a power supply line therethrough, and wherein the one or more components receive power via the power supply line.

7. The refrigerator appliance of claim 1, wherein the articulating mullion comprises a body and one or more retaining walls disposed within the body in movable engagement with the height adjustment element, wherein the retaining walls define a retaining slot complementary to the height adjustment element to receive the height adjustment element within the retaining slot.

8. The refrigerator appliance of claim 1, wherein the articulating mullion is rotatable about an articulation axis defined by the mullion hinge assembly between a first position and a second position, wherein the first position of the articulating mullion corresponds to an open position of the door and the second position of the mullion corresponds to a closed position of the door.

9. A refrigerator appliance comprising:

a cabinet defining a chamber, the cabinet comprising a front frame defining a groove;

a door coupled to the cabinet and rotatable between an open position and a closed position to selectively access the chamber; the door comprising a perimeter edge defining a longitudinal plane;

a center mullion hinge attached to the perimeter edge of the door, the center mullion hinge defining an articulation axis parallel to the longitudinal plane, the center mullion hinge comprising a complementary threaded portion;

an articulating mullion comprising a body and a pin, the body defining a retaining slot for receiving the center mullion hinge, the body being rotatably coupled to the door at the retaining slot to selectively seal the chamber, the pin extending from a top portion of body;

a height adjustment element disposed between the center mullion hinge and the body of the articulating mullion, the height adjustment element comprising a threaded portion, wherein the threaded portion of the height adjustment element and the complementary threaded portion of the center mullion hinge are in threaded engagement to adjustably attach the height adjustment element to the center mullion hinge, wherein the height adjustment element is adjustably attached to the center mullion hinge to selectively adjust a vertical position of the articulating mullion to ensure proper engagement between the pin and the groove.

10. The refrigerator appliance of claim 9, wherein the center mullion hinge comprises a mounting plate and a pivot body, wherein the mounting plate is coupled to the door, wherein the pivot body is extended from the mounting plate, wherein the pivot body is in line with the articulation axis, and wherein the pivot body comprises the complementary threaded portion.

11. The refrigerator appliance of claim 10, wherein the body of the articulating mullion defines the retaining slot for receiving the pivot body, wherein the body of the articulating mullion is rotatably coupled to the door at the retaining slot to selectively seal the chamber.

12. The refrigerator appliance of claim 11, wherein the body of the articulating mullion comprises one or more retaining walls disposed within the body and in movable engagement with the height adjustment element, wherein the retaining walls define the retaining slot complementary to the height adjustment element to receive the height adjustment element within the retaining slot.

13. The refrigerator appliance of claim 10, wherein the pivot body defines an access hole for receiving an adjustment tool, and wherein the height adjustment element is selectively adjustable via the adjustment tool.

14. The refrigerator appliance of claim 9, wherein the articulating mullion comprises one or more components therewithin, wherein the mullion hinge defines a slot for receiving a power supply line, and wherein the one or more components receive power via the power supply line.

15. The refrigerator appliance of claim 9, wherein the groove comprises cam surfaces, and wherein the pin is positioned within the cam surfaces of the groove in a closed position of the door.

* * * * *